US008038309B2

(12) United States Patent
Yang

(10) Patent No.: US 8,038,309 B2
(45) Date of Patent: Oct. 18, 2011

(54) STEREOPSIS AQUA-LAMP PHOTO FRAME STRUCTURE

(76) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 12/762,383

(22) Filed: Apr. 19, 2010

(65) Prior Publication Data

US 2010/0271809 A1 Oct. 28, 2010

(30) Foreign Application Priority Data

Apr. 28, 2009 (TW) ..... 98205694 A

(51) Int. Cl.
*F21V 33/00* (2006.01)

(52) U.S. Cl. ..... 362/101; 362/96; 362/234; 362/253; 362/604; 40/480; 40/541; 40/700; 40/714; 40/737

(58) Field of Classification Search ..... 362/96, 362/101, 227, 234, 253, 367, 602, 604, 611, 362/613, 632–633, 806; 40/406–407, 439, 40/477, 480, 541, 700, 714, 737
See application file for complete search history.

(56) References Cited

U.S. PATENT DOCUMENTS 5,408,771 A * 4/1995 Manrubia ..... 40/714
7,594,350 B2 * 9/2009 Yang ..... 40/737

* cited by examiner

*Primary Examiner* — Stephen F Husar
*Assistant Examiner* — Meghan Dunwiddie
(74) *Attorney, Agent, or Firm* — Leong C. Lei

(57) ABSTRACT

A stereopsis aqua-lamp photo frame assembly includes a base inside which a light-emitting element that generates heat is mounted. The base supports thereon an aqua-lamp photo frame that has front and rear surfaces respectively forming front-side and rear-side recessed chambers. One of the recessed chambers receives and holds therein a photo or a picture. The aqua-lamp photo frame forms therein a flow channel at a portion thereof corresponding to the two recessed chambers, whereby the heat generated by the light-emitting element causes a low boiling point flowable medium contained in the aqua-lamp photo frame to flow and spangles contained in the flowable medium entrain the flowing medium to pass through the flow channel, serving as embellishment of the photo or picture, thereby enhancing a stereopsis effect of the photo frame.

6 Claims, 6 Drawing Sheets

STEREOPSIS AQUA-LAMP PHOTO FRAME STRUCTURE

TECHNICAL FIELD OF THE INVENTION

The present invention generally relates to a stereopsis aqua-lamp photo frame assembly, and more particularly to an aqua-lamp photo frame that shows dual interesting functions of stereopsis visual effect and fluid flowing visual effect by providing a light-emitting element inside a base and an inward recessed photo frame to induce an effect of liquid flowing inside an aqua lamp so as to realize the above mentioned functions of aqua-lamp photo frame.

DESCRIPTION OF THE PRIOR ART

Decorations, such as decorative puppets/dolls, pictures, or photo frames positioned on a desk top, are commonly used in household arrangement. These decorations are commonly used as embellishment for indoor decoration and also means for improving atmosphere of the indoor surroundings. Among the most commonly accepted and used decorations is a photo frame, which can serve as an embellishment and also help holding a photo of the user or a family member or it can be used as a picture frame that holds a beautiful drawing or painting. Photo frames are often made in different forms or shapes or the configuration or material thereof is selectively changed. However, the conventional photo frames are constrained in the function thereof to simply decorations. Thus, the applications of the photo frames are very limited. It would be more consumer appealing if the photo frame could be added with an entertainment function or show an additional breakthrough in visual effect.

The applicant provided a structure of photo frame that has an additional interesting function and also shows a unique visual effect in Taiwan Utility Model Publication No. M340768, wherein an aqua-lamp photo frame assembly is disclosed, comprising a base, a motor, a light-emitting element, and a light-transmittable aqua-lamp photo frame. The base comprises a body forming an open end. The motor is mounted inside the base and has a spindle to which a magnetic element is mounted. The light-emitting element is set inside the base and is controlled by a power circuit. The light-transmittable aqua-lamp photo frame forms a vision window around which a circular hollow channel is formed. The channel receives therein a flowable liquid (which can be a low boiling point liquid, such as calcium nitrate and dichloromethane) and forms a receiving slot in the bottom thereof opposing the magnetic element carried by the motor. The slot receives therein a movable member that is caused to move by the rotation of the magnetic element. As such, when the motor drives the rotation of the magnetic element, the switch-over of the magnetic poles makes the movable member rotating to induce swirl like flow of the liquid contained in the light-transmittable aqua-lamp photo frame, and the light-emitting element generate flashing and twinkling of light.

The present invention aims to provide a stereopsis aqua-lamp photo frame assembly that provides a stereopsis visual effect for viewing and entertainment.

SUMMARY OF THE INVENTION

Thus, the present invention provides a stereopsis aqua-lamp photo frame assembly comprising a base inside which a light-emitting element that generates heat is mounted. The base has a top that receives and supports an aqua-lamp photo frame that has front and rear surfaces respectively forming front-side and rear-side recessed chambers. One of the recessed chambers receives and holds therein a photo or a picture. The aqua-lamp photo frame forms therein a flow channel at a portion thereof corresponding to the two recessed chambers, whereby the heat generated by the light-emitting element causes a flowable medium contained in the aqua-lamp photo frame to flow, and spangles contained in the medium entrain the flowing medium to pass through the flow channel, serving as embellishment of the photo or picture, thereby enhancing a stereopsis effect of the photo frame.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
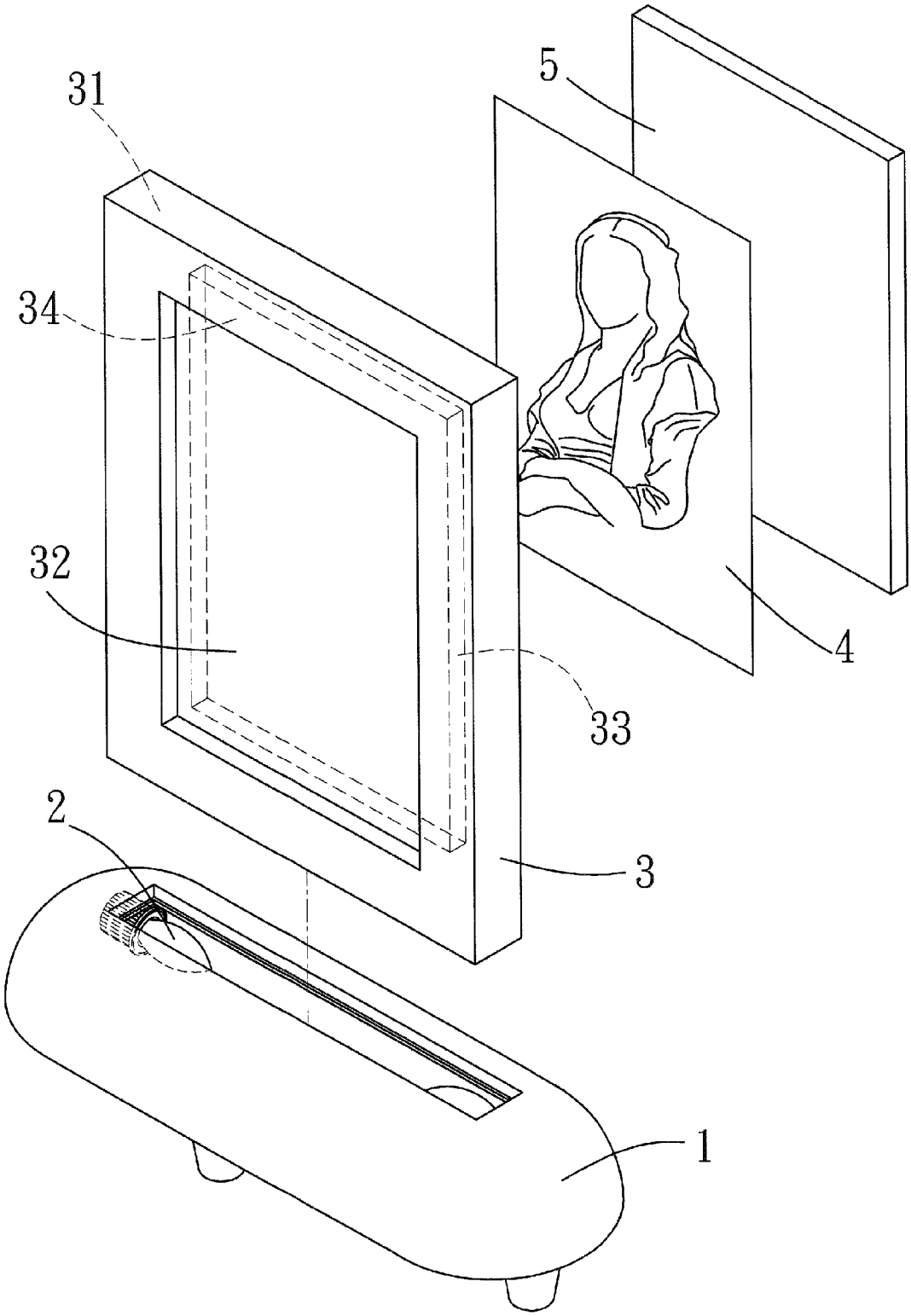
FIG. 1 is an exploded view of a stereopsis aqua-lamp photo frame assembly according to the present invention.

Referring to FIG. 1, which shows an exploded view of a stereopsis aqua-lamp photo frame assembly according to the present invention, the stereopsis aqua-lamp photo frame assembly comprises a base 1, at least one light-emitting elements 2 (two being visible in FIG. 1), and an aqua-lamp photo frame 3.

The base 1 comprises a hollow body having an open side.

The light-emitting elements 2 are received and mounted in the base 1 and are selectively and electrically connected to an electrical power source to receive electrical power therefrom for generation of lighting and heat.

The aqua-lamp photo frame 3 comprises a body that, as a whole, is light transmittable and forms a hollow chamber 31. The hollow chamber 31 receives therein a flowable medium, such as a liquid (which can be a low boiling point liquid, for example calcium nitrate and dichloromethane), containing spangles, such as shiny flasks or shiny particles. The aqua-lamp photo frame 3 has front-side and rear-side surfaces, each of which forms a recessed chamber 32, 33. The rear-side recessed chamber 33 is shaped and sized to receive a photo 4 or a picture therein. Further, the hollow chamber 31 of the aqua-lamp photo frame 3 forms an inwardly recessed width-reduced section, serving as a flow channel 34, at a portion thereof corresponding substantially to the two recessed chambers 32, 33.

Figure 2:
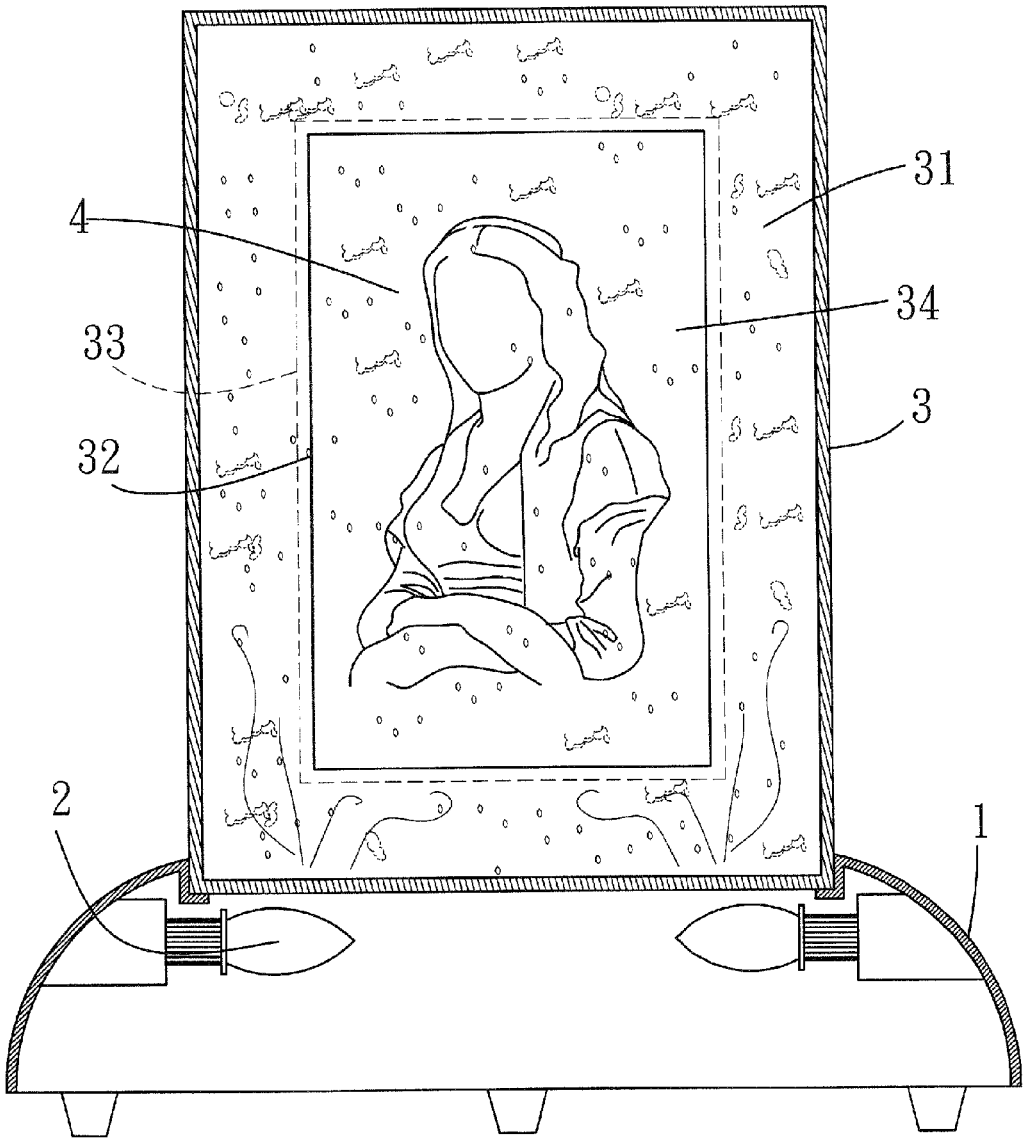
FIG. 2 is a cross-sectional view of the stereopsis aqua-lamp photo frame assembly according to the present invention.
Figure 3:
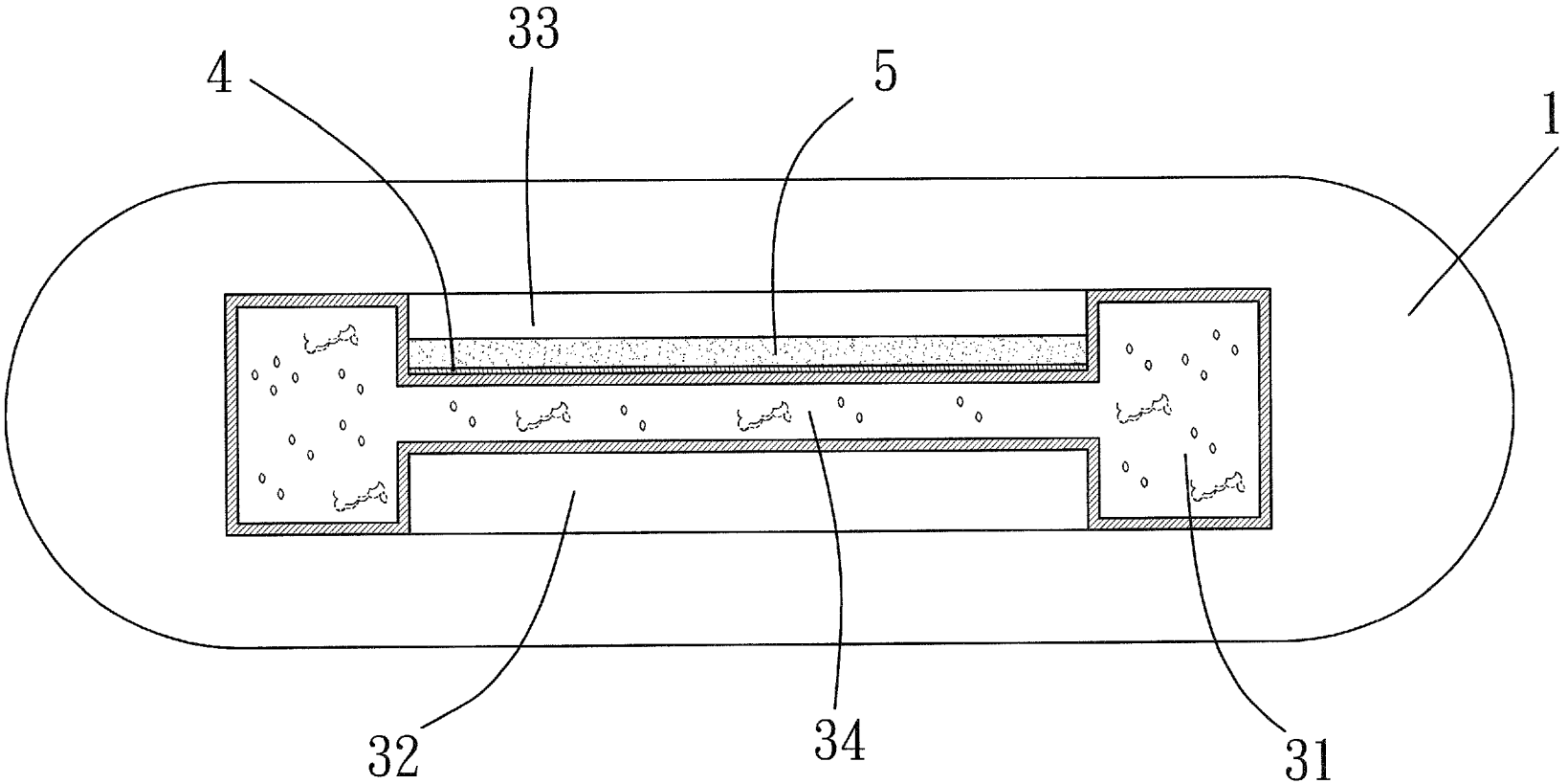
FIG. 3 is a cross-sectional view, taken from a top side, of the stereopsis aqua-lamp photo frame assembly according to the present invention.

Referring to FIGS. 2 and 3, which show cross-sectional views of the stereopsis aqua-lamp photo frame assembly according to the present invention, to use the stereopsis aqua-lamp photo frame, a photo 4 or a picture is first set in the rear-side recessed chamber 33 of the aqua-lamp photo frame 3 and, further, a retention member 5 is fit into the recessed chamber 33 to retain the photo 4 or the picture in position. Due to light diffraction induced by the front-side recessed chamber 32, stereopsis effect can be generated for the photo 4 or the picture. Further, by allowing electrical power to supply from the electrical power source (which can be an alternate current source or direct current source or even a battery of which further description will not be given for it is not related to any novel part of the invention) to the light-emitting elements 2 of the base 1, the light-emitting elements 2 are powered to emit light and heat. The aqua-lamp photo frame 3 is then positioned into the base 1 in such a way that the light-emitting elements 2 oppose a bottom face of the aqua-lamp photo frame 3, whereby the heat generated by the light-emitting elements 2 is allowed to transmit to the flowable medium, such as liquid, contained in the hollow chamber 31 of the aqua-lamp photo frame 3 and the flowable medium that receives the heat is caused to flow in a circulating manner and thus drives the shiny spangles to move with the flowing medium along a path alternately switching between the hollow chamber 31 and the flow channel 34, providing dazzlingly brilliant and fascinating embellishment for the photo or picture and the photo or picture so embellished shows a stereopsis effect.

Figure 4:
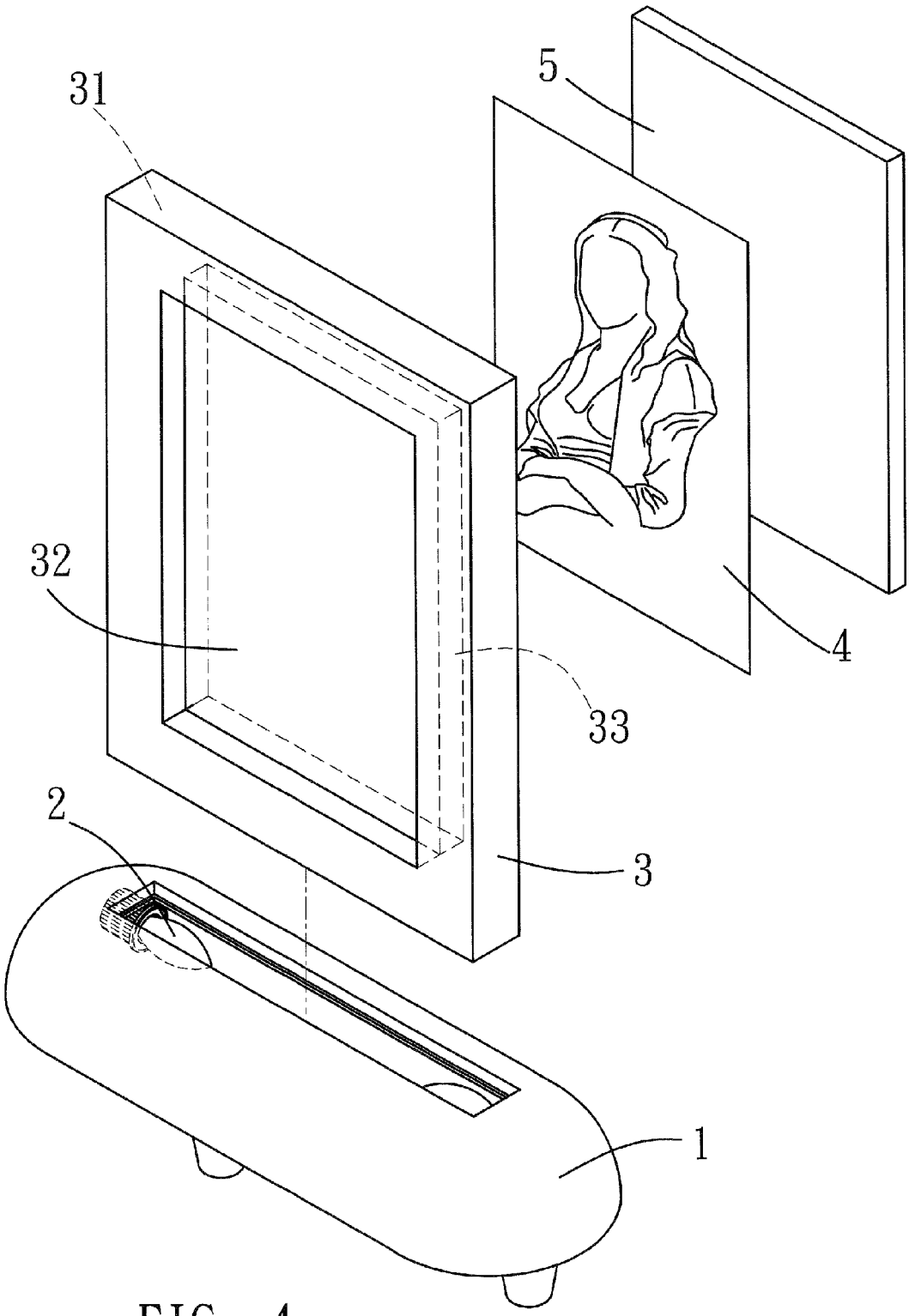
FIG. 4 is an exploded view of a stereopsis aqua-lamp photo frame assembly according to another embodiment of the present invention.
Figure 5:
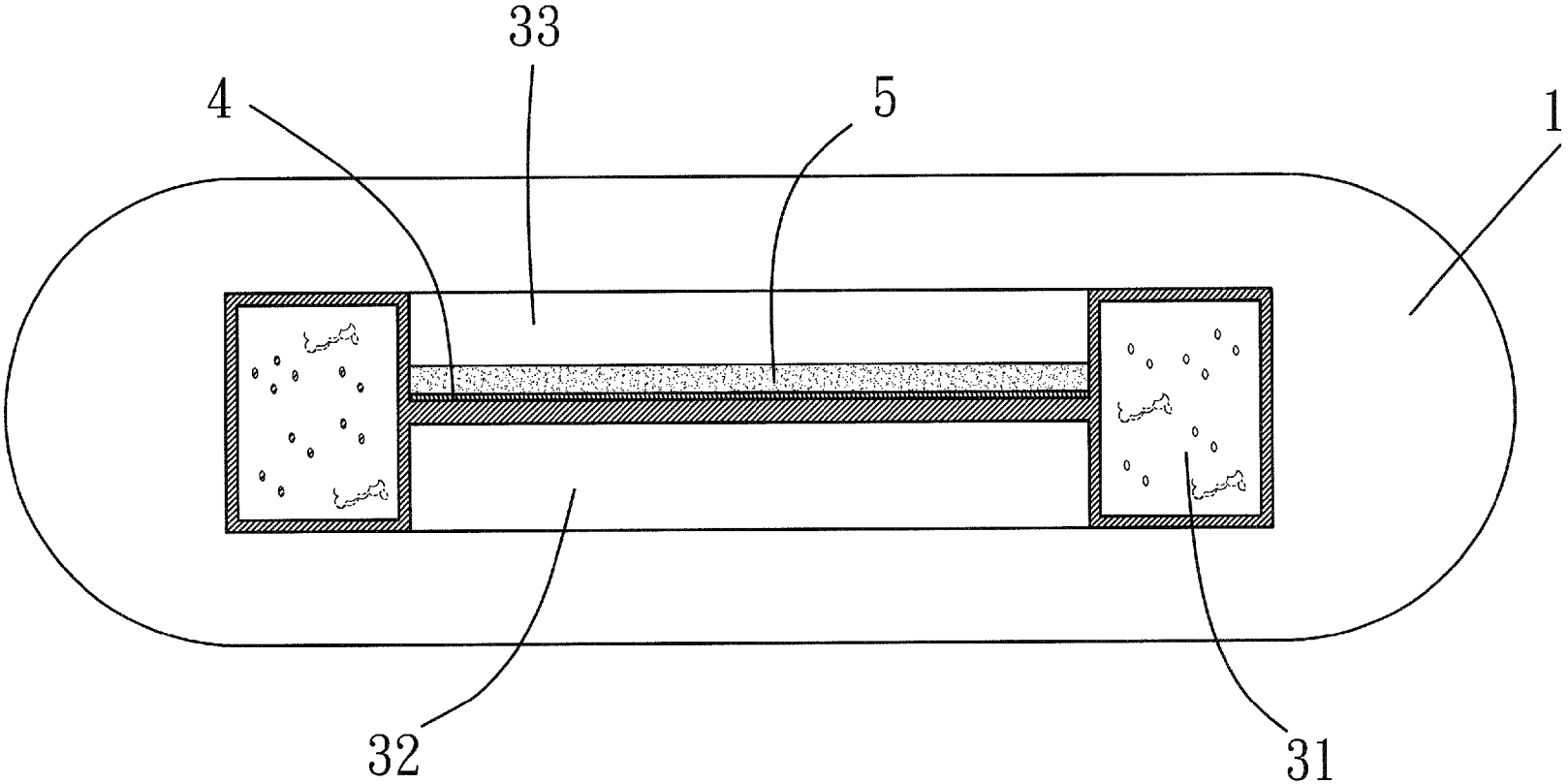
FIG. 5 is a cross-sectional view of the stereopsis aqua-lamp photo frame assembly according to said another embodiment of the present invention.

Further referring to FIGS. 4 and 5, which show an aqua-lamp photo frame assembly according to another embodiment of the present invention, an aqua-lamp photo frame 3 comprises a body forming a hollow chamber 31 and the hollow chamber 31 receives therein a flowable medium, such as a liquid (which can be a low boiling point liquid, for example calcium nitrate and dichloromethane), containing spangles, such as shiny flasks or shiny particles. The aqua-lamp photo frame 3 has front-side and rear-side surfaces, each of which forms a recessed chamber 32, 33. The rear-side recessed chamber 33 is shaped and sized to receive a photo 4 or a picture therein.

Figure 6:
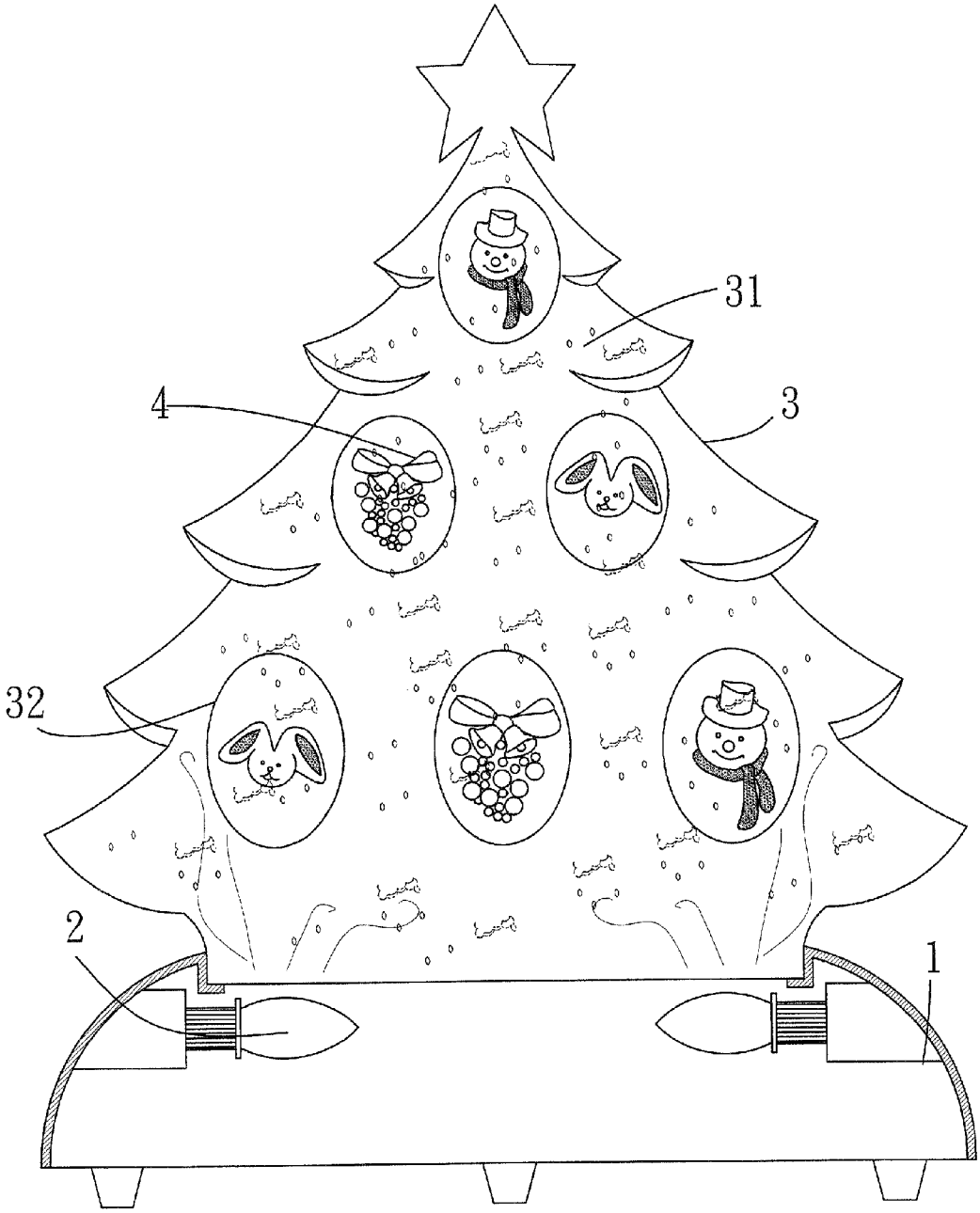
FIG. 6 is a schematic view showing a stereopsis aqua-lamp photo frame assembly according to a further embodiment of the present invention.

Referring to FIG. 6, which shows a further embodiment according to the present invention, an aqua-lamp photo frame 3 has front-side and rear-side surfaces, each of which forms a plurality of recessed chambers 32, 33. The rear-side recessed chambers 33 are respectively shaped and sized to receive photos 4 and/or pictures therein. Further, the aqua-lamp photo frame 3 can be configured as a polygonal shape as shown in FIG. 1, or a particular shape, such as a Christmas tree shown in FIG. 4, or an ellipse or any desired shape.

To summarize, the stereopsis aqua-lamp photo frame assembly according to the present invention shows several advantages, some of which are listed as follows:

(1) The stereopsis aqua-lamp photo frame assembly according to the present invention comprises a base that contains therein light-emitting elements for generating light and heat, whereby the heat causes circulation of a flowable medium, as wall as spangles entraining the circulating medium, so as to provide a photo frame that shows a unique illumination visual effect and also forms fascinating embellishment for the photo.

(2) The stereopsis aqua-lamp photo frame assembly according to the present invention comprises an aqua-lamp photo frame that forms a hollow chamber in communication with a flow channel to allow a flowable medium to alternately and interchangeably flow therebetween, whereby the flowable medium, as well as spangles that entrain the medium, is allowed to flow in front of a photo so as to form dazzlingly brilliant and fascinating embellishment for the photo and induce a stereopsis effect for the photo.

(3) The stereopsis aqua-lamp photo frame assembly according to the present invention comprises an aqua-lamp photo frame that form front-side and rear-side recessed chambers of which one receives and holds therein a photo, whereby the photo can be viewed from the other recessed chamber that provides stereopsis visual effects of magnification and light diffraction.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A stereopsis aqua-lamp photo frame assembly, comprising a base, a light-emitting element, and an aqua-lamp photo frame, wherein:

the base comprises a hollow body having an open side;

the light-emitting element is received and mounted in the base and is selectively and electrically connected to an electrical power source to generate light and heat; and the aqua-lamp photo frame comprises a body forming a hollow chamber that receives therein a flowable medium, the aqua-lamp photo frame having front and rear surfaces respectively forming front-side and rear-side recessed chambers, the rear-side recessed chamber adapted to receive and hold therein a photo, the hollow chamber of the aqua-lamp photo frame forming an inwardly recessed width-reduced section that serves as a flow channel at a portion thereof corresponding substantially to the two recessed chambers.

2. A stereopsis aqua-lamp photo frame assembly, comprising a base, a light-emitting element, and an aqua-lamp photo frame, wherein:

the base comprises a hollow body having an open side;

the light-emitting element is received and mounted in the base and is selectively and electrically connected to an electrical power source to generate light and heat; and the aqua-lamp photo frame comprises a body forming a hollow chamber that receives therein a flowable medium, the aqua-lamp photo frame having front and rear surfaces respectively forming front-side and rear-side recessed chambers, the rear-side recessed chamber adapted to receive and hold therein a photo.

3. The stereopsis aqua-lamp photo frame assembly according to claim 1, wherein the front-side and rear-side recessed chambers of the aqua-lamp photo frame are light transmittable.

4. The stereopsis aqua-lamp photo frame assembly according to claim 2, wherein the front-side and rear-side recessed chambers of the aqua-lamp photo frame are light transmittable.

5. The stereopsis aqua-lamp photo frame assembly according to claim 1, wherein the aqua-lamp photo frame is light-transmittable.

6. The stereopsis aqua-lamp photo frame assembly according to claim 2, wherein the aqua-lamp photo frame is light-transmittable.

* * * * *